US008984777B1

(12) United States Patent
Garcia-Osuna Polanco

(10) Patent No.: US 8,984,777 B1
(45) Date of Patent: Mar. 24, 2015

(54) WEIGHTED FOOTWEAR ASSEMBLY

(71) Applicant: Alejandro Garcia-Osuna Polanco, Brooklyn, NY (US)

(72) Inventor: Alejandro Garcia-Osuna Polanco, Brooklyn, NY (US)

( * ) Notice: Subject to any disclaimer, the term of this patent is extended or adjusted under 35 U.S.C. 154(b) by 219 days.

(21) Appl. No.: 13/677,378

(22) Filed: Nov. 15, 2012

(51) Int. Cl.
*A43B 5/00* (2006.01)

(52) U.S. Cl.
CPC ..... *A43B 5/00* (2013.01)
USPC ..... 36/132; 36/114; 36/136

(58) Field of Classification Search
USPC ..... 36/114, 7.1 R, 132, 136
See application file for complete search history.

(56) References Cited

U.S. PATENT DOCUMENTS 3,278,184 A * 10/1966 Rosenbaum ..... 482/105
3,306,610 A * 2/1967 Biggs, Jr. et al. ..... 482/105
3,334,898 A * 8/1967 McCrory et al. ..... 482/105
3,427,020 A * 2/1969 Montour et al. ..... 482/105
3,785,646 A * 1/1974 Ruskin ..... 482/105
4,384,714 A 5/1983 Kimura
4,458,432 A * 7/1984 Stempski ..... 36/132
D297,658 S 9/1988 Winston
5,127,891 A * 7/1992 Winston ..... 482/50
5,231,776 A 8/1993 Wagner
5,667,466 A 9/1997 Riley, Jr.
5,683,335 A 11/1997 Groves et al.
5,728,032 A * 3/1998 Glass ..... 482/105
5,893,223 A * 4/1999 Glass ..... 36/132
6,010,438 A * 1/2000 Fitzgerald ..... 482/105
6,052,924 A * 4/2000 Sabat ..... 36/132

* cited by examiner

*Primary Examiner* — Marie Bays

(57) ABSTRACT

A weighted footwear assembly includes a foot covering including a sole and a perimeter wall attached to and extending upwardly from the sole. The perimeter wall includes an upper, a heel counter and a heel collar extending upwardly from the heel counter. The foot covering includes a back side, a front side, a first lateral side and a second lateral side wherein the front side is configured to cover toes of a foot. A plurality of sleeves is attached to the perimeter wall. Each of a plurality of weights has a size and shape for being received by one of the sleeves.

7 Claims, 3 Drawing Sheets

WEIGHTED FOOTWEAR ASSEMBLY

BACKGROUND OF THE DISCLOSURE

Field of the Disclosure

The disclosure relates to footwear and weight combination devices and more particularly pertains to a new footwear and weight combination device for adding selective amounts of weight to a person's footwear in order to increase resistance while exercising legs.

SUMMARY OF THE DISCLOSURE

An embodiment of the disclosure meets the needs presented above by generally comprising a foot covering including a sole and a perimeter wall attached to and extending upwardly from the sole. The perimeter wall includes an upper, a heel counter and a heel collar extending upwardly from the heel counter. The foot covering includes a back side, a front side, a first lateral side and a second lateral side wherein the front side is configured to cover toes of a foot. A plurality of sleeves is attached to the perimeter wall. A plurality of weights is provided and each of the weights has a size and shape for being received by one of the sleeves.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
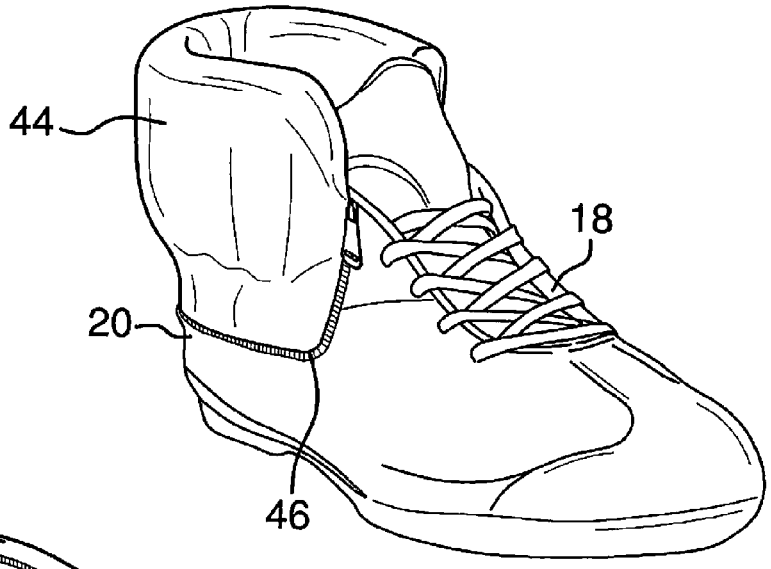
FIG. 1 is a front perspective view of a weighted footwear assembly according to an embodiment of the disclosure.
Figure 2:
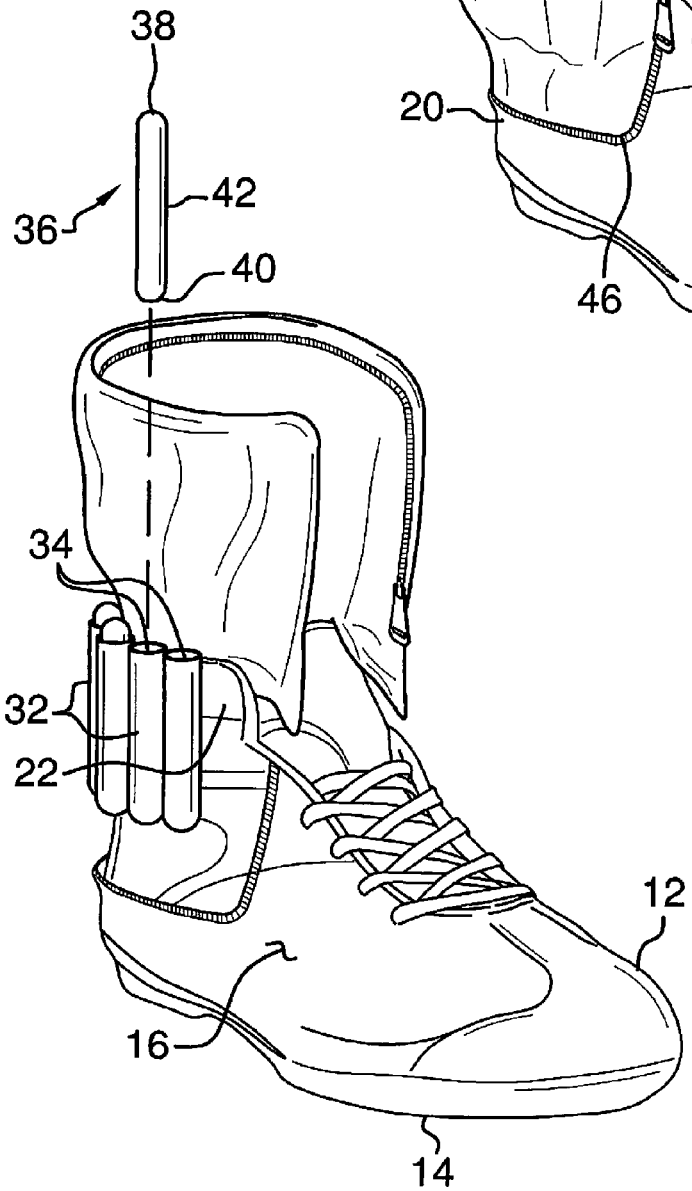
FIG. 2 is a front perspective view of an embodiment of the disclosure.

With reference now to the drawings, and in particular to FIGS. 1 through 5 thereof, a new footwear and weight combination device embodying the principles and concepts of an embodiment of the disclosure and generally designated by the reference numeral 10 will be described.

As best illustrated in FIGS. 1 through 5, the weighted footwear assembly 10 generally comprises a foot covering 12 including a sole 14 and a perimeter wall 16 attached to and extending upwardly from the sole 14. The perimeter wall 16 includes an upper 18, a heel counter 20 and a heel collar 22 extending upwardly from the heel counter 20. The foot covering 12 generally includes a back side 24, a front side 26, a first lateral side 28 and a second lateral side 30 wherein the front side 26 is configured to cover toes of a foot. The foot covering 12 is generally conventional and may include a shoe or more particularly a basketball high-top shoe or a boot such as might be used for hiking.

Figure 3:
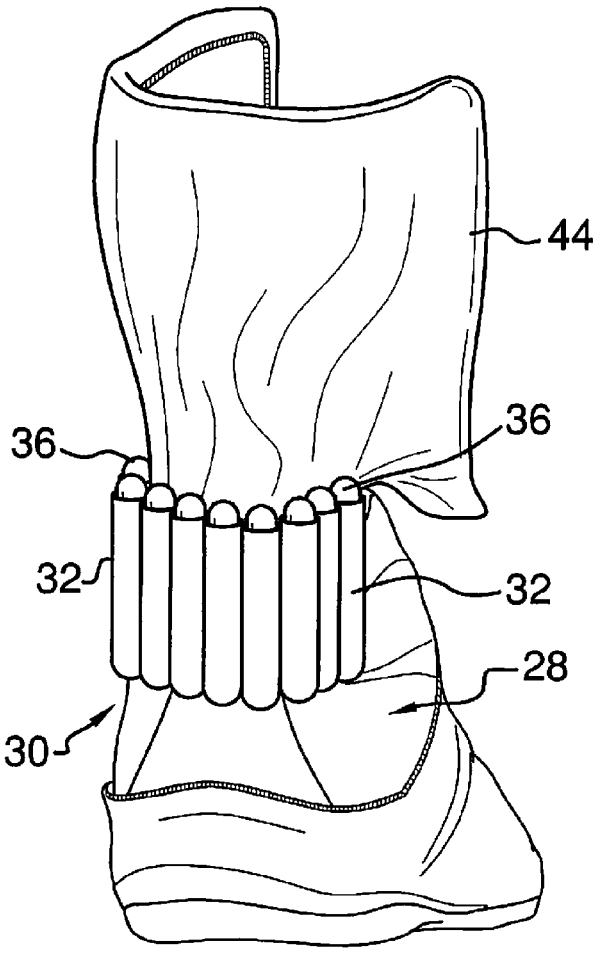
FIG. 3 is a rear perspective view of an embodiment of the disclosure.
Figure 4:
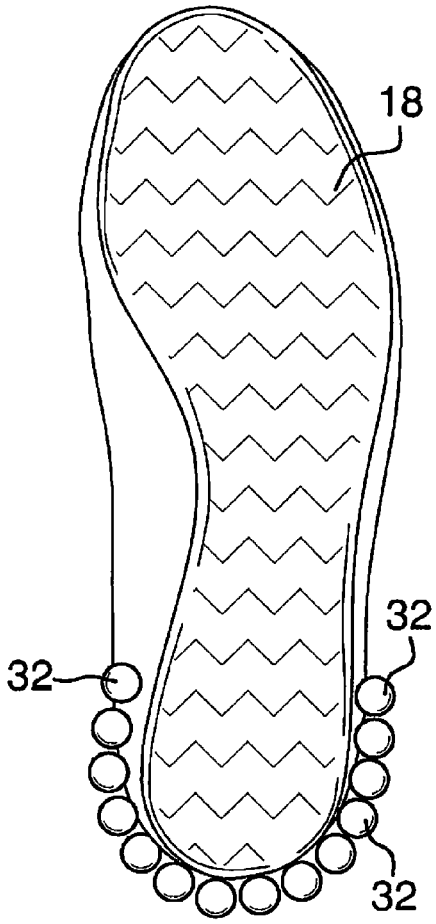
FIG. 4 is a bottom view of an embodiment of the disclosure.
Figure 5:
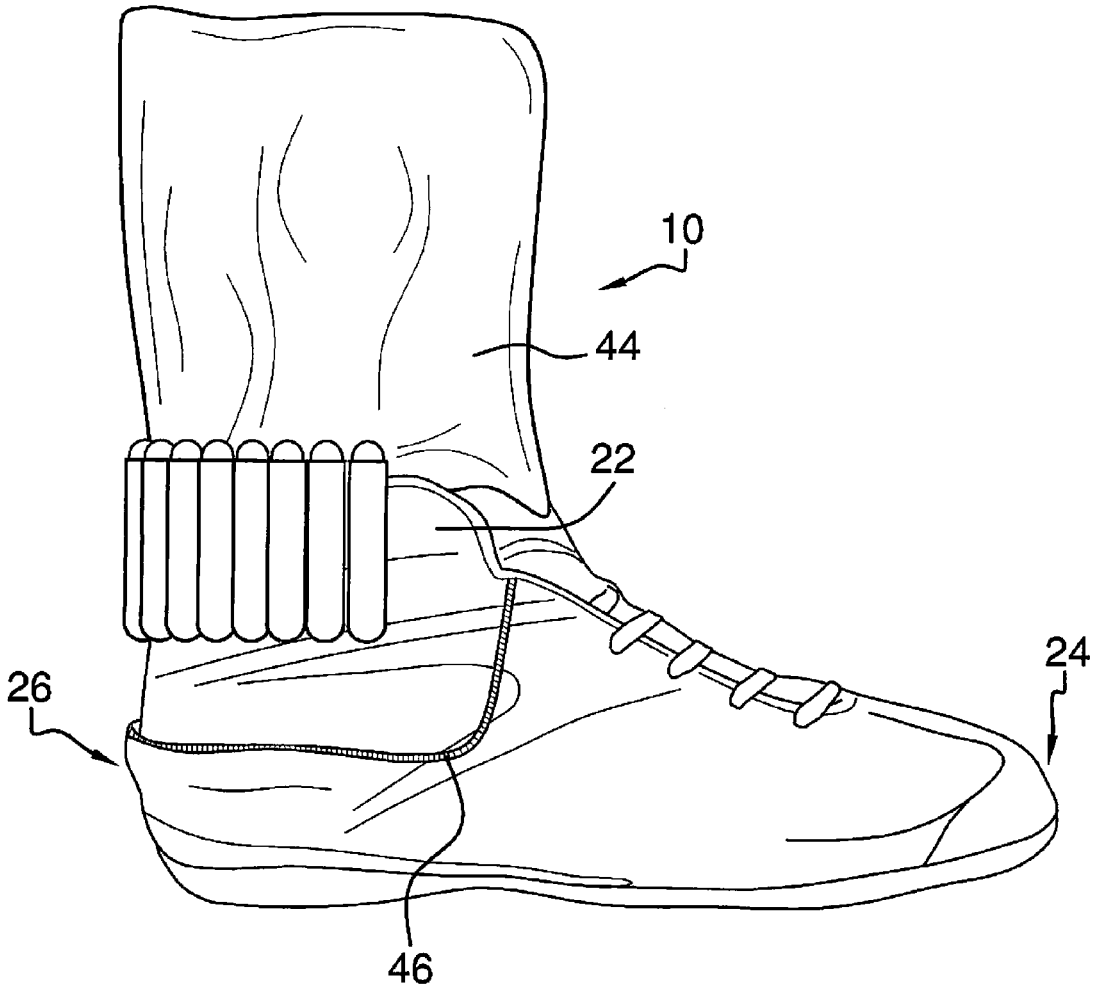
FIG. 5 is a side view of an embodiment of the disclosure.

A plurality of sleeves 32 is attached to the perimeter wall 16. The sleeves 32 are adjacent to each other and each is vertically oriented. Each of the sleeves 32 has an open upper end 34. The sleeves 32 may be positioned on the heel collar 22 and extend along the back side 26 of the foot covering 12 to each of the first 28 and second 30 lateral sides of the foot covering 12 as shown in FIGS. 3 and 4. The plurality of sleeves 32 is at least three sleeves 32 and may include more than six sleeves 32. Typically there will be less than twenty sleeves 32 on the foot covering 12.

A plurality of weights 36 is provided. Each of the weights 36 has a size and shape for being received by one of the sleeves 32. Each of the weights 36 has an upper end 38, a lower end 40 and a peripheral surface 42 extending between the upper 38 and lower 40 ends. The upper 38 and lower 40 ends may each have a convex dome shape and the peripheral surface may have a cylindrical shape. The weights 36 may each weigh between 0.02 kg and 0.40 kg and the weights 36 may be provided in different weighting increments.

A shield 44, comprised of a flexible material, is attached to the foot covering 12 adjacent to an upper edge of the heel collar 22. The shield 44 is positionable in an upright position exposing the sleeves 32 or in a folded position covering the sleeves 32. A fastener 46 is attached to the shield 44 and releasably retains the shield 44 in the folded position. While the fastener 44 shown in FIG. 1 includes a zipper including zipper sections attached to the foot covering 12 and the shield 44, the fastener 46 may include hook and loop couplers, snaps and the like.

In use, a user of the assembly wears the foot covering in a conventional manner. The user then places a desired amount of weights in the sleeves. The weights have a generally a same shape as the sleeves to prevent excess movement of the weights relative to the foot covering. The user then exercises or plays athletic games with the footwear adding increased weight to the user's feet to help provide a greater athletic work out for the user's legs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A weighted footwear assembly comprising:

a foot covering including a sole and a perimeter wall being attached to and extending upwardly from said sole, said perimeter wall including an upper, a heel counter and a heel collar extending upwardly from said heel counter, said foot covering including a back side, a front side, a first lateral side and a second lateral side wherein said front side is configured to cover toes of a foot;

a plurality of sleeves being attached directly to said perimeter wall; and a plurality of weights, each of said weights having a size and shape for being received by one of said sleeves;

a shield being attached to said foot covering adjacent to an upper edge of said heel collar, said shield being positionable in an upright position exposing said sleeves, said shield being positionable in a folded position extending fully over and covering said sleeves; and a fastener being attached to said shield extending proximate to an edge of said shield, said fastener releasably retaining said shield in said folded position such that said shield is coupled directly to said perimeter wall in spaced relationship to said sleeves.

2. The weighted footwear assembly according to claim 1, wherein each of said sleeves being adjacent to each other and each being vertically oriented, each of said sleeves having an open upper end.

3. The weighted footwear assembly according to claim 2, wherein said sleeves are positioned on said heel collar and extending from said back side of said foot covering to each of said first and second lateral sides of said foot covering.

4. The weighted footwear assembly according to claim 2, wherein said plurality of sleeves being at least three sleeves.

5. The weighted footwear assembly according to claim 1, each of said weights having a upper end, a lower end and a peripheral surface extending between said upper and lower ends, each of said upper and lower ends having a convex dome shape and said peripheral surface having a cylindrical shape.

6. The weighted footwear assembly according to claim 1, wherein each of said weights weighs between 0.02 kg and 0.40 kg.

7. A weighted footwear assembly comprising:

a foot covering including a sole and a perimeter wall being attached to and extending upwardly from said sole, said perimeter wall including an upper, a heel counter and a heel collar extending upwardly from said heel counter, said foot covering including a back side, a front side, a first lateral side and a second lateral side wherein said front side is configured to cover toes of a foot;

a plurality of sleeves being attached directly to said perimeter wall, said sleeves being adjacent to each other and each being vertically oriented, each of said sleeves having an open upper end, said sleeves being positioned on said heel collar and extending from said back side of said foot covering to each of said first and second lateral sides of said foot covering, said plurality of sleeves being more than six sleeves;

a plurality of weights, each of said weights having a size and shape for being received by one of said sleeves, each of said weights having a upper end, a lower end and a peripheral surface extending between said upper and lower ends, each of said upper and lower ends having a convex dome shape and said peripheral surface having a cylindrical shape, each of said weights weighing between 0.02 kg and 0.40 kg;

a shield being attached to said foot covering adjacent to an upper edge of said heel collar, said shield being positionable in an upright position exposing said sleeves, said shield being positionable in a folded position extending fully over and covering said sleeves; and a fastener being attached to said shield extending proximate to an edge of said shield, said fastener releasably retaining said shield in said folded position such that said shield is coupled directly to said perimeter wall in spaced relationship to said sleeves.

* * * * *